US007681994B2

(12) United States Patent
Hoisington et al.

(10) Patent No.: US 7,681,994 B2
(45) Date of Patent: Mar. 23, 2010

(54) DROP EJECTION DEVICE

(75) Inventors: Paul A. Hoisington, Norwich, VT (US); Melvin L. Biggs, Norwich, VT (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 706 days.

(21) Appl. No.: 11/084,895

(22) Filed: Mar. 21, 2005

(65) Prior Publication Data

US 2006/0209135 A1 Sep. 21, 2006

(51) Int. Cl.
*B41J 2/05* (2006.01)
*B41J 2/135* (2006.01)
*B41J 2/045* (2006.01)

(52) U.S. Cl. ..... 347/65; 347/45; 347/68

(58) Field of Classification Search ..... 347/44, 347/45, 64, 65, 68–72, 84, 85, 92
See application file for complete search history.

(56) References Cited

U.S. PATENT DOCUMENTS 4,751,532 A * 6/1988 Fujimura et al. ..... 347/55
4,825,227 A 4/1989 Fishbeck et al.
4,937,598 A 6/1990 Hine
5,265,315 A 11/1993 Hoisington et al.
5,659,346 A 8/1997 Moynihan et al.
5,757,391 A 5/1998 Hoisington
5,808,643 A * 9/1998 Tracy et al. ..... 347/92
6,137,510 A * 10/2000 Sato et al. ..... 347/63
7,052,122 B2 * 5/2006 Hoisington et al. ..... 347/92
7,237,875 B2 7/2007 Hoisington et al.
7,258,731 B2 * 8/2007 D'Urso et al. ..... 106/2
2004/0004649 A1 * 1/2004 Bibl et al. ..... 347/68
2005/0099467 A1 * 5/2005 Bibl et al. ..... 347/68

OTHER PUBLICATIONS

Kim et al., "Nanostructured Surfaces for Dramatic Reduction of Flow Resistance in Droplet-Based Microfluidics", MEMS 2002: The Fifteenth IEEE International Conference on Micro Electro Mechanical Systems, Las Vegas, Nevada, U.S.A., Jan. 20-24, 2002, Technical Digest/Sponsored by, IEEE and the Robotics and Automation Society, p. 479-482.
Torkkeli et al., "Electrostatic Transportation of Water Droplets on Superhydrophobic Surfaces", The 14th International Conference on Micro Electro Mechanical Systems: MEMS 2001, Interlaken, Switzerland, Jan. 21-25, 2001, Technical Digest/Sponsored by, IEEE and the Robotics and Automation Society, p. 475-478.
Miwa et al., "Effects of the Surface Roughness on Sliding Angles of Water Droplets on Superhydrophobic Surfaces", Langmuir, vol. 16, No. 13, 2000, pp. 5754-5760.

(Continued)

*Primary Examiner*—Stephen D Meier
*Assistant Examiner*—Geoffrey Mruk
(74) *Attorney, Agent, or Firm*—Fish & Richardson P.C.

(57) ABSTRACT

Disclosed devices include a channel having a wall with a plurality of spaced apart projections extending therefrom. The projections substantially prevent intrusion of a liquid into the projections.

30 Claims, 6 Drawing Sheets

OTHER PUBLICATIONS

Inoue et al., "Ultra-hydrophobic fluorine polymer by Ar-ion bombardment", Colloids and Surfaces B: Biointerfaces vol. 19, 2000, pp. 257-261.
Youngblood et al., "Ultrahydrophobic Polymer Surfaces Prepared by Simultaneous Ablation of Polypropylene and Sputtering of Poly(tetrafluoroethylene) Using Radio Frequency Plasma", Macromolecules, vol. 32, 1999, pp. 6800-6806.
Chen et al., "Ultrahydrophobic and Ultralyophobic Surfaces: Some Comments and Examples", Langmuir, vol. 15, No. 10, 1999, pp. 3395-3399.
Shibuichi et al., Super Water-Repellant Surfaces Resulting from Fractal Structure, J. Phys. Chem., vol. 100, No. 50, 1996, pp. 19512-19517.
Jansen et al., "The Black Silicon Method VI: High Aspect Ratio Trench Etching for MEMS Applications", IEEE the Ninth Annual International Workshop on Micro Electro Mechanical Systems: San Diego, CA, U.S.A., Feb. 11-15, 1996; sponsored by the IEEE Robotics and Automation Society, pp. 479-482.
Jansen et al., "The black silicon method: a universal method for determining the parameter setting of a fluorine-based reactive ion etcher in deep silicon trench etching with profile control", J. Micromech. Miroeng. vol. 5, 1995, pp. 115-120.
International Search Report and Written Opinion dated Oct. 4, 2007 from corresponding International Application No. PCT/US06/10382.
ASTM International Designation: D 5946-04, "Standard Test Method for Corona-Treated Polymer Films Using Water Contact Angle Measurements," 6 pages.
Office action, Chinese Application No. 200680009236.5 dated Aug. 7, 2009.
International Preliminary Report on Patentability, International Application No. PCT/US2006/010382 dated Dec. 6, 2007.

* cited by examiner

FIG. 6
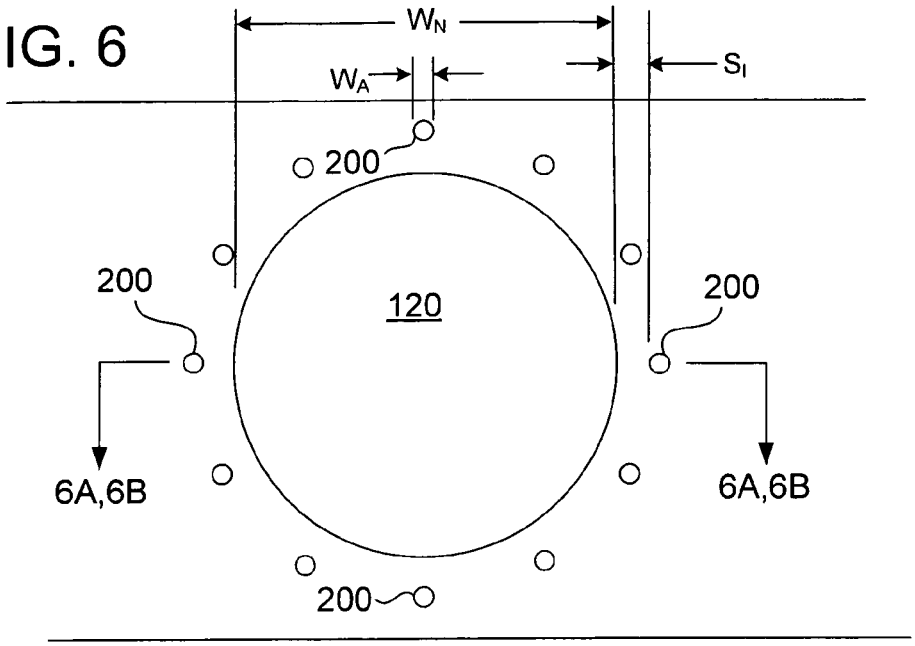
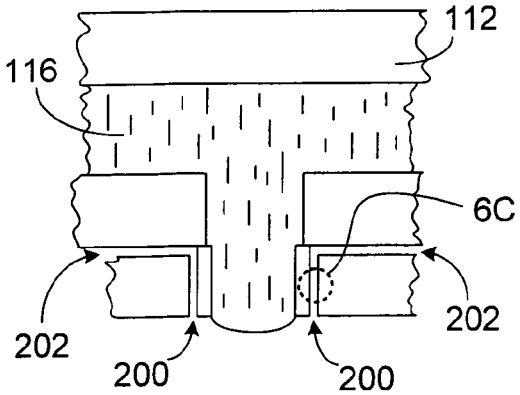
FIG. 6A
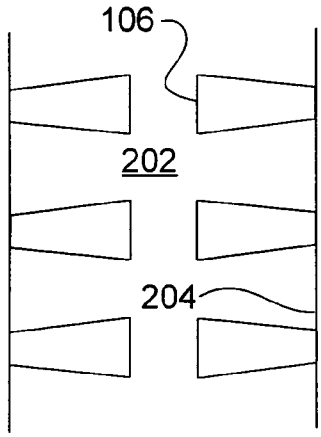
FIG. 6C
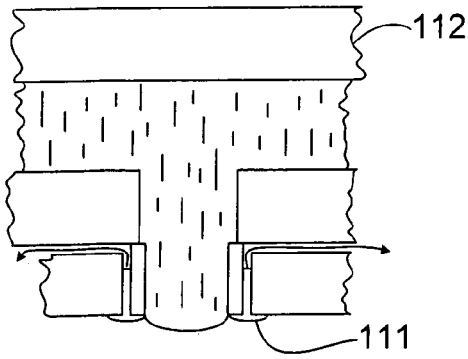
FIG. 6B

DROP EJECTION DEVICE

TECHNICAL FIELD

This invention relates to drop ejection devices, and to related devices and methods.

BACKGROUND

Ink jet printers typically include an ink path from an ink supply to a nozzle path. The nozzle path terminates in a nozzle opening from which ink drops are ejected. Ink drop ejection is controlled by pressurizing ink in the ink path with an actuator, which may be, for example, a piezoelectric deflector, a thermal bubble jet generator, or an electro-statically deflected element. A typical printhead has an array of ink paths with corresponding nozzle openings and associated actuators, such that drop ejection from each nozzle opening can be independently controlled. In a drop-on-demand printhead, each actuator is fired to selectively eject a drop at a specific pixel location of an image as the printhead and a printing substrate are moved relative to one another. In high performance printheads, the nozzle openings typically have a diameter of 50 microns or less, e.g. around 35 microns, are separated at a pitch of 100-300 nozzle/inch, have a resolution of 100 to 3000 dpi or more, and provide drop sizes of about 1 to 70 picoliters or less. Drop ejection frequency is typically 10 kHz or more.

Printing accuracy of printheads, especially high performance printheads, is influenced by a number of factors, including the size and velocity uniformity of drops ejected by the nozzles in the printhead.

Hoisington et al. U.S. Pat. No. 5,265,315, describes a print assembly that has a semiconductor body and a piezoelectric actuator. The body is made of silicon, which is etched to define ink chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path. Piezoelectric ink jet print assemblies are also described in Fishbeck et al. U.S. Pat. No. 4,825,227, Hine U.S. Pat. No. 4,937,598, Moynihan et al. U.S. Pat. No. 5,659,346, Hoisington U.S. Pat. No. 5,757,391 and Bibl et al., published U.S. Patent Application No. 2004/0004649.

SUMMARY

The invention relates to drop ejection devices, and to related devices and methods.

In general, the invention features devices that include a liquid channel having a wall and a plurality spaced apart projections, e.g., an array or field of projections, extending from the wall into the channel. The projections are configured and dimensioned to prevent intrusion of the liquid, e.g., an ink or a biological fluid, into the projections.

In one aspect, the invention features a drop ejection device that includes a liquid channel having a wall. A plurality of spaced apart projections extend from the wall into the channel. The projections substantially prevent intrusion of the liquid into the projections.

In another aspect, the invention features a method of liquid ejection. The method includes providing a drop ejection device that includes a liquid channel having a wall with a plurality of spaced apart projections extending from the wall into the channel. The projections substantially prevent intrusion of the liquid into the projections. Liquid is supplied to the channel, and the liquid is ejected through a nozzle in fluid communication with the channel by pressurizing the liquid. In some implementations, the liquid is an ink, e.g., having a surface tension of about 10-60 dynes/cm and a viscosity of about 1 to 50 centipoise.

In another aspect, the invention features a method of degassing a liquid that includes providing a channel having a wall having a plurality of spaced apart projections extending from the wall into the channel, and an aperture defined in the wall from which the projections extend. The aperture is in fluid communication with a pump. The projections substantially prevent intrusion of the liquid into the projections. Liquid is introduced into the channel, and the pump is operated such that the pressure about the aperture is less than atmospheric pressure.

In another aspect, the invention features a method of degassing a liquid that includes providing a channel having a wall having a plurality of spaced apart projections extending from the wall into the channel to terminal ends. The projections substantially prevent intrusion of the liquid into the projections. A vacuum source is in communication with a region between the wall and the terminal ends of the projections, and liquid is introduced into the channel.

In another aspect, the invention features a method of removing a bubble from a liquid. A channel is provided having a wall having a plurality of spaced apart projections extending from the wall into the channel to terminal ends. The projections substantially prevent intrusion of the liquid into the projections. A vacuum source is in communication with a region between the wall and the terminal ends of the projections, and liquid is introduced into the channel. In some implementations, the bubble has a diameter of less than 5 micron, e.g., 4 micron, 3 micron, 2 micron, 1 micron, or less, e.g., 0.5 micron.

Other aspects or embodiments, may include combinations of the features in the aspects above and/or one or more of the following. The channel is disposed adjacent a pumping chamber that includes a pressurizing actuator, e.g., a piezoelectric actuator. The channel is at least partially defined in a substrate that comprises a silicon material. The channel includes a plurality of walls. The channel is non-circular in cross-section. Each projection includes a hydrophobic coating, e.g., having a thickness of from about 100 angstrom to about 750 angstrom. A droplet of liquid in the channel can form a contact angle of, e.g., from about 150 degrees to about 176 degrees. The hydrophobic coating includes a fluoropolymer. The projections extend from substantially the entire wall of the channel. The channel has a plurality of walls, and projections extend from each wall of the channel. Each projection is substantially perpendicular to the wall from which it extends. Each projection is substantially circular in transverse cross-section. A transverse cross-sectional area of each projection at the wall is less than a transverse cross-sectional area at a terminal end. Each projection tapers from the wall to a terminal end, the terminal end having a maximum transverse dimension of less than 0.3 micron. A spacing between immediately adjacent projections, measured edge-to-edge at terminal ends, is less than about 1 micron. A height of each projection, measured perpendicular to the wall, is from about 2 microns to about 35 microns. Each projection has a substantially equivalent height, measured perpendicular to the wall. The channel is part of a waste control system configured to move waste liquid away from a region proximate a nozzle opening. A density of the projections is from about $6.0\times10^{9}$ projections/$m^2$ to about $3.0\times10^{11}$ projections/$m^2$. The channel is defined by laminated plates.

An apparatus can be constructed from a plurality of any of the devices described above.

Embodiments may have one or more of the following advantages. The spaced apart projections can be incorporated into any liquid flow path, e.g., adjacent a pumping chamber, thereby allowing the liquid, e.g., an ink, to flow through the flow path with reduced resistance. Flow resistance can be reduced by, e.g., 60, 70, 80, 90, 95 or even over 99% when compared with flow paths not containing such projections. Lower resistance to flow enables, e.g., a more rapid refilling of the pumping chamber. For example, rapidly refilling the pumping chamber can translate into an ability to eject drops at a higher frequency, e.g., 25 kHz, 50 kHz, 100 kHz or higher, e.g., 150 kHz. Higher frequency printing can improve the resolution of ejected drops by increasing the rate of drop ejection, reducing size of the ejected drops, and enhancing velocity uniformity of the ejected drops. Rapid refilling of the pumping chamber can also reduce ejection errors, e.g., misfires, due air ingestion at the nozzle, which can lead to a reduction in print quality. In addition to lowering fluid flow resistance, the spaced apart projections are generally small, and so occupy little space. Because the flow resistance is less, the liquid flow path thickness can be reduced, often resulting in further miniaturization of a printing device. Another advantage of the spaced apart projections is that they can absorb energy, thereby reducing acoustic interference effects, e.g., cross-talk, among individual drop ejectors that are contained in a printing apparatus. In addition, the field of spaced apart projections can be used in conjunction with a vacuum source to degas a liquid flowing in the flow path without the need for a membrane to contain the liquid in the path. Such degassing when used in a printing device can be particularly efficient when it is performed in close proximity to a pumping chamber. As a result, the liquid can be degassed efficiently, which leads to improved purging processes within the printing device, as well as improved high frequency operation, e.g., less rectified diffusion. In some configurations, the spaced apart projections can remove bubbles from a liquid as the liquid flows past the projections. Without wishing to be bound by any particular theory, it is believed that the low flow resistance and energy absorption advantages arise from air trapped within the projections.

All publications, patent applications, patents, and other references mentioned herein are incorporated by reference in their entirety.

Other aspects, features, and advantages will be apparent from the description and drawings, and from the claims.

DESCRIPTION OF DRAWINGS

FIG. 4A is a perspective, exploded view of an alternative laminate flow path.

FIG. 6 is a top view of a portion of a drop ejection device showing a nozzle opening and cleaning apertures proximate the nozzle opening.

FIGS. 6A and 6B are cross-sectional views of the drop ejection device of FIG. 6.

FIG. 6C is an enlarged view of area 6C of FIG. 6A.

DETAILED DESCRIPTION

In general, devices are disclosed that include a liquid channel having a wall and a plurality of spaced apart projections extending from the wall into the channel. The projections substantially prevent intrusion of the liquid, e.g., an ink or a biological fluid, into the projections. Such channels can be used, e.g., to lower fluid flow resistance in the channel, to degas the liquid in the channel and/or remove bubbles from the liquid, or to provide an energy absorbing flow path for reduced acoustic interference effects, e.g., cross-talk.

Figure 1:
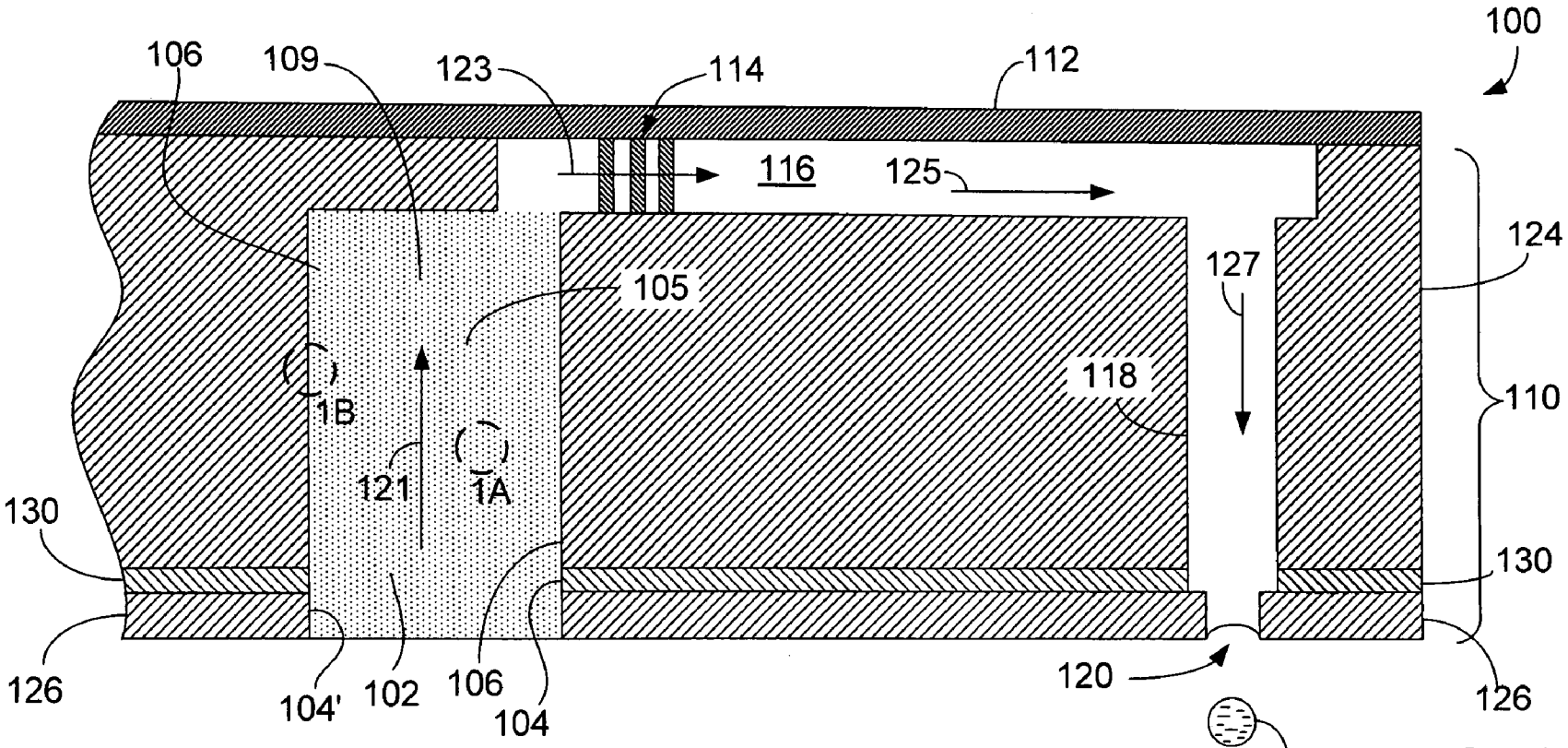
FIG. 1 is a cross-sectional view of a drop ejection device.

Referring to FIG. 1, a drop ejection device 100 includes a liquid channel 102 that is rectangular in cross-section. Channel 102 is defined by opposite pairs of walls 104, 104' and 105, 105' (not seen in this cross-sectional view). Extending from each wall of channel 102 are a plurality of projections 106. Projections 106 are configured to substantially prevent intrusion of the liquid 109 into projections 106, e.g., by minimizing spacing between adjacent projections and coating the projections with a hydrophobic material, e.g., polytetrafluoroethylene. Device 100 also includes a substrate 110 and an actuator 112, e.g., piezoelectric actuator. Substrate 110 defines channel 102, a filter 114, a pumping chamber 116, a nozzle path 118 and a nozzle opening 120. Actuator 112 is positioned over pumping chamber 116. Liquid 109 is supplied from a manifold flow path (not shown) to channel 102 (arrow 121), and is then directed through filter 114 (arrow 123) into pumping chamber 116 (arrow 125). Liquid 109 in pumping chamber 116 is pressurized by actuator 112 such that the pressure is transmitted along nozzle path 118 (arrow 127), resulting in ejection of a drop 122 from nozzle opening 120.

Substrate 110 can be, e.g., a monolithic semiconductor, such as a silicon on insulator (SOI) substrate, in which channel 102, pumping chamber 116 and nozzle path 118 are formed by etching. In such a case, substrate 110 can include an upper layer 124 made of single crystal silicon, a lower layer 126 also made of single crystal silicon, and a buried layer 130 made of silicon dioxide. Substrates formed in this manner can have a high thickness uniformity, as described by Bibl et al. in published U.S. Patent Application No. 2004/0004649.

Referring now to FIGS. 1, 1A, 1B and 1C, liquid 109 enters channel 102 (arrow 121) adjacent pumping chamber 116 with reduced resistance to flow when compared to a similarly dimensioned channel without such projections 106. Without wishing to be bound by any particular theory, it is believed that this reduced resistance to flow arises because liquid 109 is supported by terminal ends 130 of projections 106, effectively reducing the amount of contact between fluid 109 and walls 104, 104', 105 and 105'. This reduces frictional forces between liquid 109 and channel 102, enabling the observed reduced fluid flow resistance. In some embodiments, flow resistance can be reduced by, e.g., 60, 70, 80, 90, 95 or even over 99%. Lowering fluid flow resistance can enable higher frequency jetting and improved resolution. Lowering fluid flow resistance can also enable miniaturization improvements because a similar resistance to flow can be obtained with thinner channels.

Projections 106 can be produced by deep reactive ion etching (DRIE) methods. For example, methods for making "micro-grass," have been described by Jansen in *J. Micromech. Microeng.* 5, 115-120 (1995) and *IEEE,* 250-257 (1996). In addition, Kim has disclosed methods in *IEEE,* 479-482 (2002).

The material from which the projections are made, together with spacing, size, location, shape, number and pattern of projections are selected to prevent intrusion of liquid 109 into projections 106. While reduced resistance to flow arises when liquid 109 is supported by terminal ends 130, increased flow resistance is observed when the projections are wetted by fluid 109.

Figure 1A:
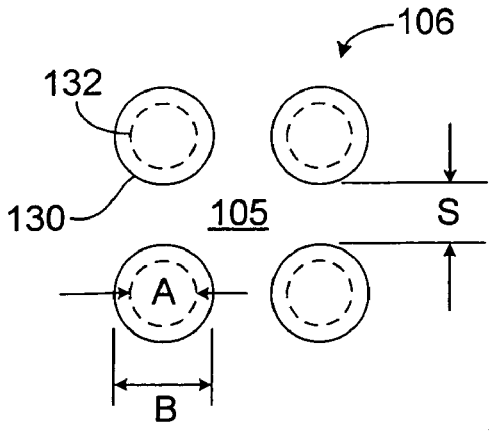
FIG. 1A is an enlarged view of area 1A of FIG. 1.

Referring particularly to FIG. 1A, in one embodiment, a material is selected, and the size S of the spaces between projections 106 is such that the liquid will not be drawn into the openings defined by neighboring projections by either capillary forces or during an application of a pressure that is, e.g., about 2.5 atmospheres, 2.0 atmospheres, 1.5 atmospheres, or less, e.g., 0.5 atmospheres, above ambient atmospheric pressure. In embodiments, projections 106 are made of a material (or coated with a material) that is sufficiently hydrophobic, and the size S of the spacing between neighboring projections, measured edge-to-edge at terminal ends 130, is less than about 2 micron, e.g., 1.50 micron, 1.25 micron, 1.00 micron, 0.75 micron or less, e.g., 0.25 micron. In some embodiments, projections 106 define a series of rows and columns. In other embodiments, the pattern defined by projections 106 is less orderly, and more random than rows and columns.

In particular embodiments, in order to prevent intrusion of liquid 109 into projections 106, each projection includes a hydrophobic coating, e.g., a fluoropolymer coating, and the spacing S between immediately adjacent projections 106 is from less than about 1 micron. Generally, a coating thickness of from about 100 angstrom to about 750 angstrom is sufficient to make projections 106 sufficiently hydrophobic. Coatings can be placed on projections by, e.g., spin-coating using TEFLON®. Coatings can also be placed on projections 106 by using a DRIE method that utilizes a fluorine-based plasma. A spin-coating procedure has been described by Kim in *IEEE,* 479-482 (2002). Hydrophobic surfaces are also discussed in Inoue et al., *Colloids and Surfaces, B: Biointerfaces* 19, 257-261 (2000), Youngblood et al., *Macromolecules* 32, 6800-6806 (1999), Chen et al., *Langmuir* 15, 3395-3399 (1999), Miwa et al., *Langmuir* 16, 5754-5760 (2000), Shibuichi et al., *J. Phys. Chem.* 100, 19512-19517 (1996), and Härmä et al., *IEEE,* 475-478 (2001).

Figure 3:
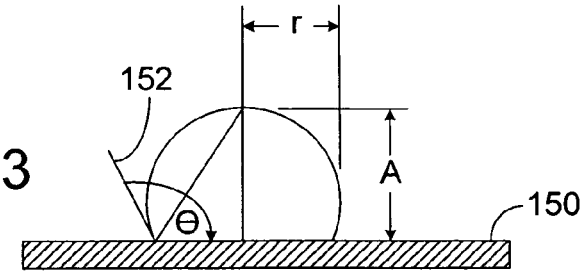
FIG. 3 is a side view, illustrating measurement of contact angle.

Referring to FIG. 3, hydrophobicity of a substrate is related to its wetability by a liquid, e.g., an ink. It is often desirable to quantitate the hydrophobicity of a substrate by a contact angle. Generally, as described in ASTM D 5946-04, to measure contact angle θ for a liquid, an angle is measured between a baseline 150 and a tangent line 152 drawn to a droplet surface of the liquid at a three-phase point. Mathematically, θ is 2arc tan (A/r), where A is a height of the droplet's image, and r is half width at the base. For channel 102 with projections 106, baseline 150 is defined by terminal ends of projections 106. In some embodiments, it is desirable to have contact angle θ of between about 150 degrees and about 176 degrees, e.g., about 155 degrees to about 175 degrees or 160 degrees to about 172 degrees.

In some embodiments, in order to prevent intrusion of liquid 109 into projections, each projection 106 includes a hydrophobic coating, and the projections are present at a density of from about $6.0\times10^{9}$ projections/$m^2$ to about $3.0\times10^{11}$ projections/$m^2$.

Figure 1B:
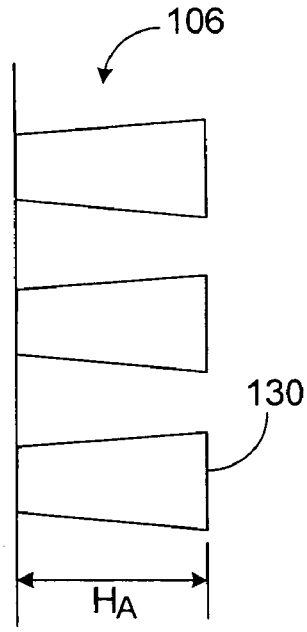
FIG. 1B is an enlarged view of area 1B of FIG. 1.

In some embodiments, each projection 106 is substantially perpendicular to the wall from which it extends, and each projection is substantially circular in transverse cross-section. Referring particularly to FIG. 1B, in some embodiments, a height $H_A$ of each projection 106, measured perpendicular to the wall from which it extends, is from about 0.25 micron to about 35 micron, e.g., 0.5, 0.75, 0.9, 1, 2, 5 micron or more, e.g. 10 micron.

It is estimated that a particular embodiment where each projection 106 includes a 250 angstrom thick fluoropolymer coating and a spacing between neighboring projections is about 1 micron, will enable a 5-fold reduction in channel cross-sectional area relative to a channel not containing projections, while at the same time maintaining a similar flow resistance to the channel not having projections.

Figure 1C:
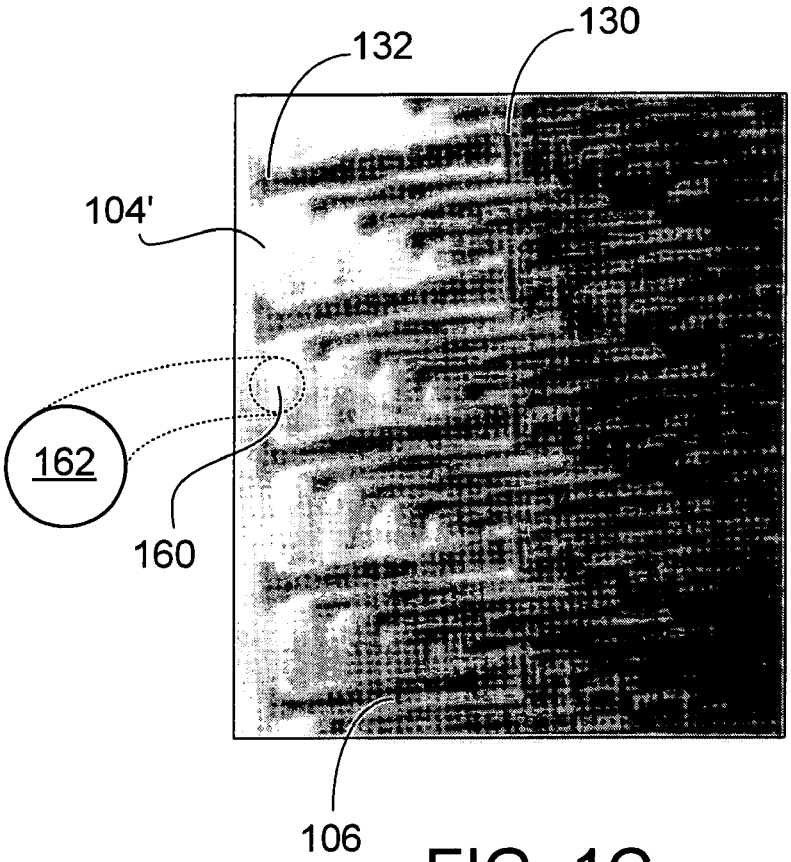
FIG. 1C is an enlarged perspective view the projections of FIG. 1.

Channel 102 can be used in conjunction with a vacuum source to degas liquid 109 flowing through channel 102. Such degassing can be particularly efficient when it is performed in close proximity, e.g., adjacent, to pumping chamber 116. Efficiently degassed fluids can lead to improved purging processes which can result in improved high frequency operation with, e.g., less rectified diffusion. Referring to FIGS. 1A and 1C, channel 102 can be used to degas liquid 109 by defining an aperture 160 in wall 104' and by having aperture 160 in fluid communication with a vacuum source 1C. When projections 106 are coated with TEFLON® and the size S of the spacing between neighboring projections is 1 micron, a pressure in aperture 160 can be about 750 mm Hg below ambient atmospheric pressure without intrusion of liquid 109 into projections 106.

Figure 4:
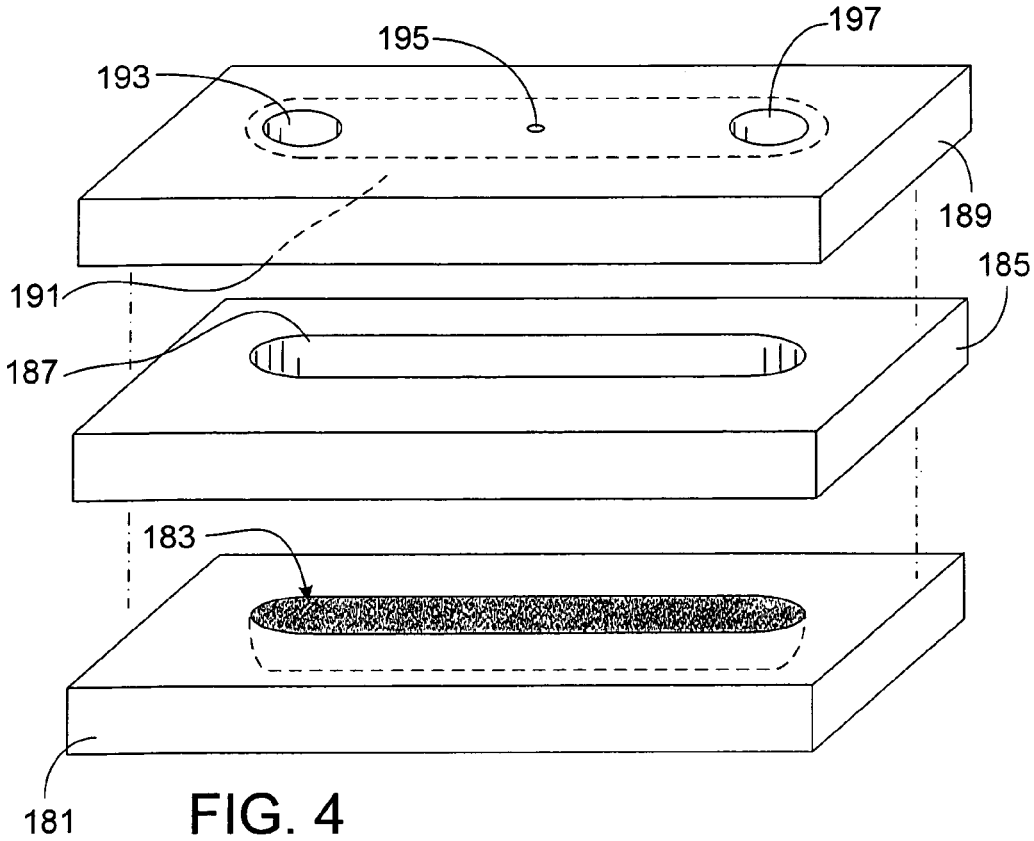
FIG. 4 is a perspective, exploded view of a laminate flow path.

Referring to FIG. 4, in some embodiments, a channel is formed by laminating three plates together. For example, bottom plate 181 includes a sunken cut-out 183 that includes a wall having a plurality of projections 109. Middle plate 185 includes an elongated, oval-shaped aperture 187 that complements cut-out 183. Top plate 189 includes a sunken cut-out 191 that complements aperture 187 of middle plate 185 and cut-out 183 of bottom plate 181. Sunken cut-out 191 also has a wall having a plurality of projections 109. Top plate 189 includes three apertures 193, 195 and 197. Plates 181, 185 and 189 are assembled, e.g., by gluing, such that cut-outs 183 and 191 align with aperture 187, producing a channel. After assembly, liquid flows into aperture 193 and exits aperture 197. A vacuum can be applied to aperture 195 (or a plurality of such apertures if desired) for degassing liquid 109. In some embodiments, a diameter of the aperture 195 is approximately equal to the spacing S between projections, e.g., less than 1 micron, e.g., 0.5 micron, and a diameter of each aperture 193 and 195 is less than 15 mm, e.g., 10 mm, 5 mm or less, e.g., 1 mm.

Figure 4C:
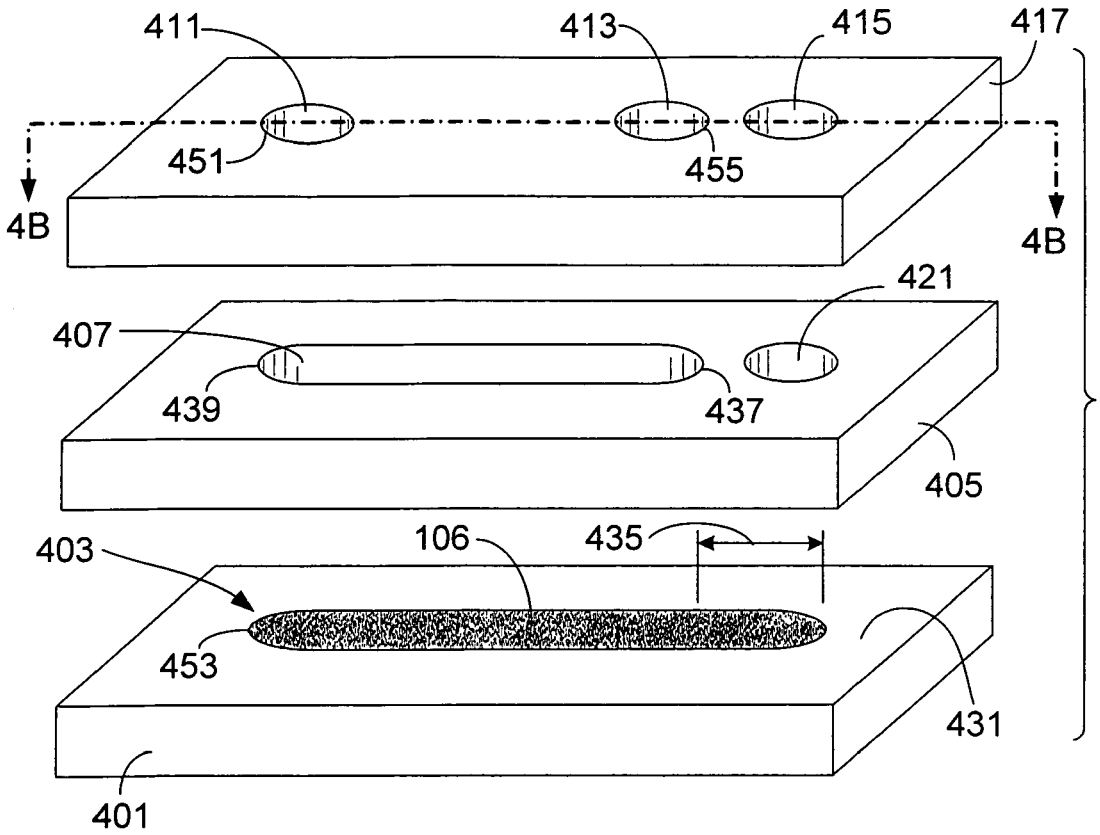
FIG. 4C is a highly enlarged view of area 4C of FIG. 4B.
Figure 4C:
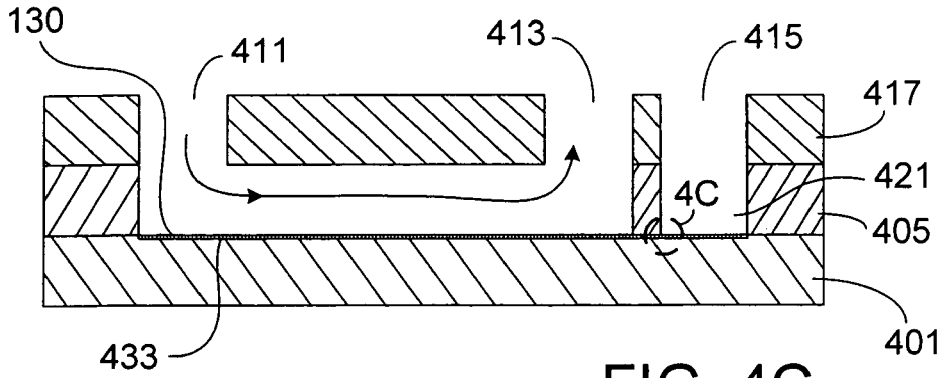
Figure 4B:
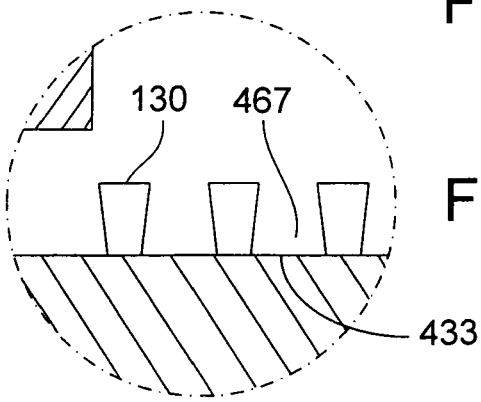
FIG. 4B is cross-sectional view of the flow path of FIG. 4A, taken along 4B-4B.

Alternative laminated flow paths are possible For example, referring to FIGS. 4A, 4B, and 4C, a flow channel is formed by laminating a bottom plate 401, a middle plate 405 and a top plate 417. Top plate 417 includes three apertures 411, 413 and 415. Bottom plate 401 includes an oval-shaped etched region 403 that bounds a plurality of projections 106 that extend from a wall 433 that is sunken relative to a top surface 431 of plate 401 by an amount equal to the height of the projections. Therefore, the terminal ends 130 of projections 106 are coplanar with surface 431. Middle plate 405 includes an elongated, oval-shaped aperture 407 having a lateral extent defined by edges 437 and 439. The elongated oval complements region 403, except for a portion 435 that extends a distance beyond an edge 437 of aperture 407. Plates 401, 405 and 417 are assembled, e.g., by gluing, such that edge 451 of aperture 411 lines up with edge 439 of aperture 407, and edge 439 lines up with edge 453 of region 403. At the same time, edge 455 of aperture 413 is aligned with edge 437 of aperture 407, and aperture 415 of plate 417 is aligned with aperture 421 of plate 405. When assembled, aperture 415 is connected to a source of vacuum (not shown). This enables a vacuum source to communicate with a region 467 between the wall 433 and the terminal end 130 of each projection 106 for degassing the liquid and/or removing bubbles, e.g., having a diameter of less than 10 micron, e.g., 5, 4, 3 micron or less, e.g., 1 micron. In some embodiments, a diameter of each aperture 411 and 413 and 415 is less than 15 mm, e.g., 10 mm, 5 mm or less, e.g., 1 mm.

Figure 2A:
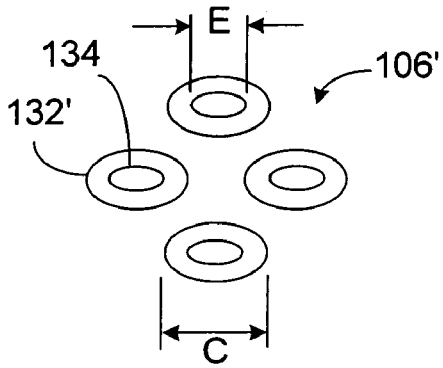
FIG. 2A is a top view of projections for an alternative embodiment.
Figure 2B:
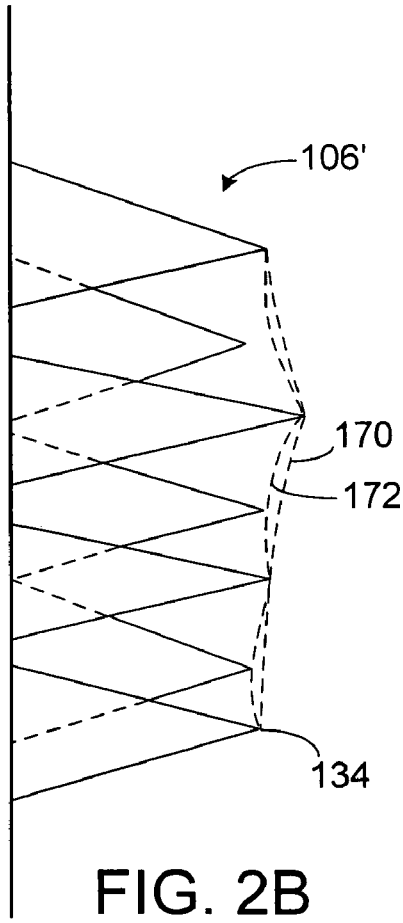
FIG. 2B is a side view of the projections of FIG. 2A.
Figure 2C:
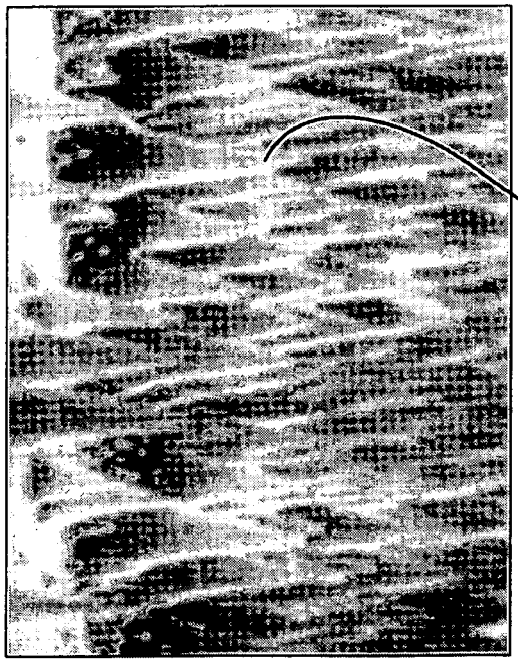
FIG. 2C is a perspective view of the projections of FIG. 2A.

Referring back to FIGS. 1A and 1C, in some embodiments, projections 106 have a smaller transverse cross-sectional area at an intersection 132 of projection 106 and wall than at the terminal end 130 of projection 106. For example, a maximum transverse dimension A at an intersection 132 of projection 106 and the wall can be, e.g., 1 micron, and a maximum transverse dimension B at the terminal end 130 of projection 106 can be, e.g., 2 micron. Referring to FIGS. 2A and 2C now, in some embodiments, each projection 106' tapers from an intersection 132' of projection 106' and wall to a sharp terminal end 134. In some embodiments, each projection 106' has a maximum transverse dimension C of less than 2 micron at the intersection 132' of projection 106' and the wall, and tapers to a sharp terminal end 134, having a maximum transverse dimension E of less than 0.3 micron, e.g., 0.2 micron or less, e.g., 0.05 micron.

In addition to reduced resistance to fluid flow, we have found that projections 106 are highly compliant in that the air captured by projections 106 can absorb energy, thereby reducing acoustic interference effects, e.g., cross-talk, among individual drop ejectors that are arrayed in a printing apparatus. Referring to FIGS. 1 and 2B, during ejection of a drop 122, pumping chamber 116 is pressurized by actuator 112 such that the pressure is transmitted along nozzle path 118, resulting in ejection of a drop 122 from nozzle opening 120. Pressure is also transmitted to channel 102 during drop ejection. As a result, liquid 109 in channel 102 is slightly pushed into projections 106 from a nominal meniscus position 170 to a higher pressure meniscus position 172. This slight intrusion can create a compliance that is much greater than that of the ink, effectively reflecting a pressure wave back into the pumping chamber, preventing energy generated in one drop ejection device from interfering with drop ejection of a proximate, e.g., adjacent, drop ejection device. After pressurization, meniscus position 172 returns to meniscus position 170. It is estimated that a 55 square micron area of projections having a 250 angstrom thick fluoropolymer coating and a spacing between neighboring projections of about 1 micron will provide a 1 pico-liter/psi compliance.

In some configurations, the spaced apart projections can act to remove bubbles in a liquid as the liquid flows transversely past the projections.

Figure 5:
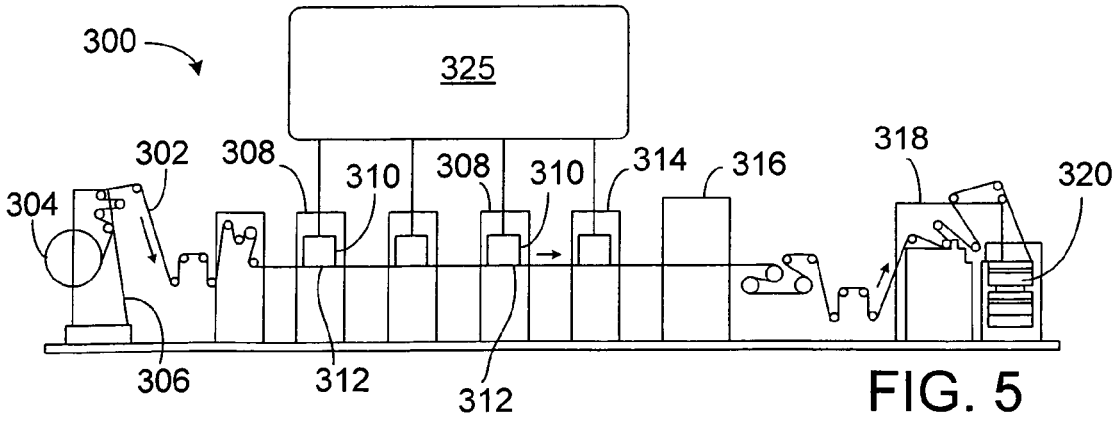
FIG. 5 is a side view of an apparatus for printing on a substrate.

Devices 100 can be arrayed to produce an apparatus for depositing drops on a substrate. FIG. 5 illustrates an apparatus 300 for continuously depositing droplets, e.g., ink droplets, on a substrate 302 (e.g., paper). Substrate 302 is pulled from roll 304 that is on supply stand 306 and fed to a series of droplet-depositing stations 308 for placing a plurality droplets, e.g., different colored droplets, on substrate 302. Each droplet-depositing station 308 has a droplet ejection assembly 310 positioned over the substrate 302 for depositing droplets on the substrate 302. Each droplet ejection assembly includes a plurality of the devices of FIG. 1, e.g., from about 250 to about 1000 such devices or more. A controller 325 provides signals to actuators 112 of devices 100 to eject drops in a predetermined pattern. Below the substrate 302 at each droplet ejection assembly 310 is a substrate support structure 312 (e.g., a platen). After the substrate 302 exits the final depositing station 314, it may go to a pre-finishing station 316. The pre-finishing station 316 may be used for drying substrate 302. Next, substrate 302 travels to the finishing station 318, where it is folded and slit into finished product 320. In some embodiments, substrate 302 is fed at a rate of about 0.25 meters/second to about 5.0 meters/sec or higher.

While channel 102 has been illustrated above in a liquid supply pathway, in some embodiments, channel 102 is part of a waste control system configured to move waste liquid away from a region proximate a nozzle opening. A waste control system has been described by Hoisington et al. in "Droplet Ejection Assembly," U.S. patent application Ser. No. 10/749,829.

Referring now to FIGS. 1, 6, 6A, 6B and 6C, nozzle 120, having a nozzle width, $W_N$, is which surrounded by waste ink control apertures 200, having an aperture width, $W_A$. The apertures generally surround nozzle 120 and are spaced a distance $S_1$ from the periphery of the nozzle opening 120. Over time, fluid can form puddles about the nozzle opening which can cause printing errors. Apertures 200 remove waste liquid before it can form excessive puddles. In embodiments, the apertures are spaced closely adjacent the nozzle periphery. For example, in embodiments, spacing is about 200% or less, e.g., 50% or less, e.g. 20% or less of the nozzle width. In embodiments, apertures are positioned at greater spacing from the nozzle periphery, e.g., 200% to 1000% or more of the nozzle diameter. In embodiments, the apertures can be provided at various spacings, including closely spaced apertures and apertures of greater spacing. In embodiments, there are three or more apertures associated with each nozzle. In particular embodiments, the apertures have a width of about 30% or less, e.g. 20% or less or 5% or less than the nozzle width. The vacuum on the apertures during fluid withdrawal is about 0.5 to 10 inwg or more. The nozzle width is about 200 micron or less, e.g. 10 to 50 micron. The ink or other jetting fluid has a viscosity of about 1 to 40 cps. Multiple nozzles are provided in a nozzle plate at a pitch of about 25 nozzles/inch or more, e.g. 100-300 nozzles/inch. The drop volume is about 1 to 70 pL.

Referring particularly to FIG. 6A, apertures 200 are in communication with a channel 202 that leads to a vacuum source, e.g., a mechanical vacuum apparatus (not shown), that intermittently or continuously creates a vacuum. Referring to FIG. 6B, the vacuum draws waste ink 111 from about the nozzle (arrows). The ink drawn from the nozzle plate can be recycled to an ink supply or directed to a waste container. Referring to FIG. 6C, a channel 202 having a wall 204 with a plurality of projections 106 extending from wall 204 substantially lowers liquid flow resistance in channel 202. This reduces the vacuum requirements needed to remove waste fluid 111.

Still further embodiments follow.

For example, while ink can be jetted in a printing operation, the drop ejection devices described can be utilized to eject fluids other than ink. For example, the deposited droplets may be a UV or other radiation curable material or other material, for example, chemical or biological fluids, capable of being delivered as drops.

While a channel has been described for use in a drop ejection device, the channel described could be part of a precision dispensing system, e.g., for high-throughput screening assays. The channels can be part of another apparatus, e.g., any fluid handling system, e.g., a blood handling system, in which it is desired not to damage cells during handling. In addition, such channels can be used in any fluid handling system to degas a fluid when that is desirable.

While a piezoelectric actuator has been discussed, other electromechanical actuators can be utilized. In addition, a thermal actuator can be utilized.

While closed channels have been discussed, open channels can be used.

While certain projection shapes have been described, other projection shapes are possible, e.g., square, pentagonal, hexagonal, octagonal, and oval.

Still other embodiments are within the scope of the following claims.

What is claimed is:

1. A drop ejection device comprising:

a pumping chamber including a pressurizing actuator;

a liquid channel having a wall, the channel being disposed adjacent to the pumping chamber; and a plurality of spaced apart projections extending from the wall into the channel, wherein the projections substantially prevent intrusion of a liquid into spaces between the projections, the projections are arranged to reduce flow resistance in the channel, and each projection includes a hydrophobic coating having a thickness between about 100 angstrom and about 750 angstrom.

2. The device of claim 1, wherein the pressurizing actuator comprises a piezoelectric material.

3. The device of claim 1, wherein the channel is at least partially defined in a substrate that comprises a silicon material.

4. The device of claim 1, wherein the channel includes a plurality of walls.

5. The device of claim 1, wherein the channel is non-circular in cross-section.

6. The device of claim 1, wherein a droplet of liquid in the channel forms a contact angle of from about 150 degrees to about 176 degrees on the projections.

7. The device of claim 1, wherein the hydrophobic coating comprises a fluoropolymer.

8. The device of claim 1, wherein the projections extend from substantially the entire wall of the channel.

9. The device of claim 1, wherein the channel has a plurality of walls, and wherein the projections extend from each wall of the channel.

10. The device of claim 1, wherein each projection is substantially perpendicular to the wall from which it extends.

11. The device of claim 1, wherein each projection is substantially circular in transverse cross-section.

12. The device of claim 1, wherein a transverse cross-sectional area of each projection at the wall is less than a transverse cross-sectional area at a terminal end.

13. The device of claim 1, wherein each projection tapers from the wall to a terminal end, the terminal end having a maximum transverse dimension of less than about 0.3 micron.

14. The device of claim 1, wherein a spacing between immediately adjacent projections, measured edge-to-edge at terminal ends, is less than about 1 micron.

15. The device of claim 1, wherein a height of each projection, measured perpendicular to the wall, is from about 2 microns to about 35 microns.

16. The device of claim 1, wherein each projection has a substantially equivalent height, measured perpendicular to the wall.

17. The device of claim 1, further comprising an aperture defined in the wall from which the projections extend.

18. The device of claim 17, wherein the aperture is in fluid communication with a vacuum source.

19. The device of claim 1, wherein the channel is a part of a waste control system configured to move waste liquid away from a region proximate a nozzle opening.

20. The device of claim 1, wherein a density of the projections is from about $6.0\times10^{9}$ projections/$m^2$ to about $3.0\times10^{11}$ projections/$m^2$.

21. The device of claim 1, wherein the channel is defined by laminated plates.

22. An apparatus for depositing drops on a substrate, comprising a plurality of the devices of claim 1.

23. A method of liquid ejection comprising:

providing a drop ejection device that comprises a pumping chamber including a pressurizing actuator;

a liquid channel having a wall, the channel being disposed adjacent to the pumping chamber; and a plurality of spaced apart projections extending from the wall into the channel, wherein the projections substantially prevent intrusion of a liquid into spaces between the projections, the projections are arranged to reduce flow resistance in the channel, and each projection includes a hydrophobic coating having a thickness between about 100 angstrom and about 750 angstrom;

supplying the liquid to the channel; and ejecting the liquid through a nozzle in fluid communication with the channel using the pressurizing actuator.

24. The method of claim 23, wherein the liquid comprises an ink.

25. The method of claim 23, wherein the liquid has a surface tension of about 10-60 dynes/cm.

26. The method of claim 23, wherein the liquid has a viscosity of about 1 to 50 centipoise.

27. A method of degassing a liquid comprising:

providing a channel disposed adjacent to a pumping chamber, the channel having a wall from which a plurality of spaced apart projections extend into the channel, wherein the projections substantially prevent intrusion of the liquid into spaces between the projections, the projections are arranged to reduce flow resistance in the channel, and each projection includes a hydrophobic coating having a thickness between about 100 angstrom and about 750 angstrom; and an aperture defined in the channel being in fluid communication with a pump;

introducing the liquid into the channel; and operating the pump such that the pressure about the aperture is less than atmospheric pressure.

28. A method of removing a bubble from a liquid comprising:

providing a channel disposed adjacent to a pumping chamber, the channel having a wall from which a plurality of spaced apart projections extend into the channel at terminal ends, wherein the projections substantially prevent intrusion of the liquid into spaces between the projections, the projections are arranged to reduce flow resistance in the channel, each projection includes a hydrophobic coating having a thickness between about 100 angstrom and about 750 angstrom, and a vacuum source is in communication with a region between the wall and the terminal ends of the projections; and introducing the liquid into the channel.

29. The method of claim 28, wherein the bubble has a diameter of less than 5 micron.

30. The method of claim 29, wherein the bubble has a diameter of less than 2 micron.

* * * * *